United States Patent [19]

Maeda et al.

[11] Patent Number: 4,918,569

[45] Date of Patent: Apr. 17, 1990

[54] REGULATED FORWARD CONVERTER FOR GENERATING REPEATING SPARK DISCHARGE PULSES

[75] Inventors: Tsutomu Maeda; Kiyoshi Matsui; Takayuki Kanno; Kunihiro Sato, all of Tokyo, Japan

[73] Assignee: TDK Corporation, Tokyo, Japan

[21] Appl. No.: 411,265

[22] Filed: Sep. 25, 1989

Related U.S. Application Data

[63] Continuation of Ser. No. 212,642, Jun. 28, 1988, abandoned.

[30] Foreign Application Priority Data

Jun. 30, 1987 [JP] Japan ..... 62-163214
Jun. 30, 1987 [JP] Japan ..... 62-163634

[51] Int. Cl.[4] ..... F23Q 3/00

[52] U.S. Cl. ..... 361/263; 123/605; 123/650; 123/652; 315/219; 363/131

[58] Field of Search ..... 363/131, 97; 361/247, 361/253, 263; 315/209 T, 219; 123/605, 650, 652

[56] References Cited

U.S. PATENT DOCUMENTS 3,034,018 5/1962 Rosenberg ..... 315/219
3,319,618 5/1967 Sohner ..... 315/209 T
4,355,263 10/1982 Buhrlein ..... 315/209 T
4,418,375 11/1983 Ober ..... 315/209 T
4,495,446 1/1985 Brown et al. ..... 315/219

FOREIGN PATENT DOCUMENTS 57-173559 10/1982 Japan .
58-75921 5/1983 Japan .
61-167478 10/1986 Japan .
61-55612 11/1986 Japan .
61-269675 11/1986 Japan .

*Primary Examiner*—William H. Beha, Jr.
*Attorney, Agent, or Firm*—Armstrong, Nikaido, Marmelstein, Kubovcik & Murray

[57] ABSTRACT

A discharge load driving circuit has a transformer with a low voltage coil and a high voltage coil wound around a magnetic core. The high voltage coil has a transformation ratio for setting a high self-resonance frequency value for the transformer to thereby output high voltage at a short rise time period. The discharge load driving circuit further includes a switching element connected to the transformer for switching on and off a d-c input supplied thereto through the low voltage coil of the transformer. The discharge load driving circuit further includes a driver circuit for driving a switching element driving pulse, a control circuit for controlling the driver circuit, a discharge load connected to the high voltage coil for discharging load by a high voltage output generated in the high voltage coil when the switching element is turned on, and a detector for detecting a flow of discharge current in the discharge load. The switching element repeats its on-off action in a predetermined. For supplying a required amount of discharge energy to the discharged load until self-propagation of a flame subsequent to generation of a flame nucleus by a spark discharge of the discharge load.

5 Claims, 3 Drawing Sheets

REGULATED FORWARD CONVERTER FOR GENERATING REPEATING SPARK DISCHARGE PULSES

This application is a continuation of application Ser. No. 212,642, filed June 28, 1988, now abandoned.

BACKGROUND OF THE INVENTION

1. Field of the Invention

The present invention relates to a circuit for driving a discharge load such as a spark plug, a discharge electrode of a combustor or the like. And more particularly it relates to a forward type circuit configuration which feeds to a discharge load a high voltage output obtained from a high voltage coil of a transformer in accordance with turn-on of a switching element actuated to switch on and off a d-c input supplied thereto through a low voltage coil of the transformer, whereby exact ignition can be effected in the discharge load without failure under the condition that the rise time is shortened and still the duration of high voltage application is set to be sufficiently long equivalently.

2. Description of the Prior Art

In the conventional systems relative to such discharge load driving circuit of the type mentioned, there are generally known a capacitor discharge ignition system (hereinafter referred to as CDI system) and a full transistor system utilizing flyback energy of a transformer. FIG. 3 shows a discharge load driving circuit of such CDI system, whrein there are included a d-c power source 1, a power switch 2, a transformer 3, a switching element 4 consisting of a thyristor or the like, a capacitor 5, a discharge load 6 consisting of a discharge electrode of a spark plug, a combustor or the like, a current limiting resistor 7, and a resistor 8 for protecting a power source. The transformer 3 has a low voltage coil 31 and a high voltage coil 32. The d-c power source 1, the switch 2 and the switching element 4 are connected in series to the low voltage coil 31, and the capacitor 5 is connected between the anode of the switching element 4 and the ground. The high voltage coil 32 is grounded at one end thereof while the discharge load 6 is connected to the other end thereof via the resistor 7.

When the d-c power source 1 is connected by closing the switch 2, the capacitor 5 is charged through the protective resistor 8 so that its terminal voltage is increased. And upon arrival of the terminal voltage of the capacitor 5 at a predetermined level, a terminal voltage signal is fed to a control electrode of the switching element 4, which is thereby turned on. When the switching element 4 is turned on, a high voltage is generated in the transformer 3 due to the resonance of its inductance L with the capacitance C of the capacitor 5. The high voltage thus generated is applied via the high voltage coil 32 of the transformer 3 to the discharge load 6 to consequently cause a discharge of the load 6.

FIG. 4 shows the waveform of the coil voltage obtained from the transformer 3 in the circuit of FIG. 3, wherein the high voltage has a duration $T_c$ starting from the power-on instant $t_o$.

FIG. 5 shows a discharge load driving circuit of full transistor system. In this diagram, the same reference numerals as those used in the foregoing example of FIG. 3 denote corresponding components. The main circuit of a switching element 4 consisting of a transistor and so forth is inserted between one end of a low voltage coil 31 of a transformer 3 and the ground, and a pulse signal is fed from a driving circuit 9 to a control electrode of the switching element 4 to perform a switching operation. The polarity of the low voltage coil 31 and the high voltage coil 32 of the transformer 3 is so predetermined that, in accordance with turn-off of the switching element 4, a high voltage output is generated in the high voltage coil 32 by a release of the flyback energy.

When the switching element 4 is driven by the driving circuit 9 in a state where the switch 2 is closed to connect the power source 1, the exciting energy accumulated in the transformer 3 during the on-time of the switching element 4 is obtained as flyback energy from the high voltage coil 32 upon subsequent turn-off of the switching element 4 and then is applied to the discharge load 6, thereby generating a spark discharge in the load 6. FIG. 6 shows the waveform of the coil voltage obtained from the transformer 3 in this stage of operation.

However, there exist the following problems in the conventional discharge load driving circuits mentioned above.

(a) Problems in CDI system

Since a high voltage is generated by the resonance of the capacitance C of the capacitor 5 and the inductance L of the transformer 3, it is impossible to attain a sufficiently long duration Tc of the high voltage application. In the general CDI system, the duration $T_c$ is at most 100 μs or so which is insufficient as a discharge duration for a spark plug or the like. Consequently there occurs deficiency of the discharge energy to bring about inadequate propagation of a flame, hence causing incomplete combustion.

Generally a charge time of 2 ms or so is necessary to raise the terminal voltage of the capacitor 5 up to a level required for turning on the switching element 4. Therefore it is difficult to increase the discharge energy by repeating such discharge operations.

(b) Problems in full transistor system

Although the duration $T_c$ is relatively long as 1 ms or so, the rise time Tr is prolonged as will be described below. In relation to the inductance L of the transformer 3 and the exciting current I, the exciting energy E accumulated in the transformer 3 during the on-time of the switching element 4 is expressed as $$E=\frac{1}{2}.L.I^2$$

The exciting energy E is released synchronously with turn-off of the switching element 4 and is applied to the discharge load 6 to discharge the same. For ensuring a predetermined amount of the exciting energy E, therefore, it is necessary that the inductance L of the transformer 3 be set above a certain value. Meanwhile, in relation to the inductance L and the distributed capacity C, the self-resonance frequency f of the transformer 3 is expressed as $$f=\frac{1}{2}\pi\sqrt{LC}$$

As is clear from the above two equations, if the inductance L is set to be sufficiently great to ensure the required exciting nergy E for driving the discharge load 6, the self-resonance frequency f is lowered while the rise time Tr is prolonged. Consequently, in case the surface of the spark plug constituting the discharge load 6 is soiled and the resistance value derived from such soil is not negligible, the operation is prone to become unstable as a spark discharge is not generated to eventually induce failure of ignition.

SUMMARY OF THE INVENTION

The present invention has been accomplished in an attempt to solve the problems mentioned above. And its object resides in providing an improved discharge load driving circuit which is capable of performing exact ignition of a discharge load without failure by realizing a short rise time and setting a sufficiently long duration of high voltage application equivalently.

For the purpose of achieving the above object, the discharge load driving circuit of the present invention comprises a transformer having a low voltage coil and a high voltage coil, a switching element actuated to switch on and off a d-c input supplied thereto through the low voltage coil of the transformer, and a discharge load connected to the high voltage coils so as to be discharged by a high voltage output generated in the high voltage coil in accordance with turn-on of the switching element.

The discharge load driving circuit of the present invention is formed into a forward type circuit configuration where the discharge load is supplied with a high voltage output transmitted from the low voltage coil of the transformer of the high voltage coil thereof in accordance with turn-on of the switching element. In such circuit configuration, the requisite is satisfied if the low voltage coil and the high voltage coil of the transformer are coupled to each other at a certain transformation ratio, and the coupling degree may be lower than that in the flyback type. Therefore the required inductance of the transformer is reduced equivalently, whereby the self-resonance frequency of the transformer can be set at a higher value, and consequently the rise time Tr is shortened in comparison with that in the conventional full transistor system.

Furthermore, a high voltage output of the duration corresponding to the width of the switching-element driving pulse is obtainable, so that it becomes possible to repeat the on-off action of the switching element in a predetermined short period for supplying the discharge energy to the discharge load until self-propagation of a flame subsequent to generation of a flame nucleus by a spark discharge of the discharge load, hence equivalently extending the duration of high voltage application.

In the discharge load driving circuit of the present invention, the magnetic core of the transformer is composed of a selected material having an initial permeability of 1500 or more at a frequency of 200 kHz and a saturation magnetic flux density of 300 mT or more in a field strength of 1600 A/m at a temperature of 120° C., so that fast pulse driving is rendered possible and still sufficient durability is achievable at high temperature, thereby meeting the requisites for a component of an ignition system in an internal combustion engine.

Further, in the discharge load driving circuit of the present invention, an electric field effective transistor is used as a switching element, so that fast pulse driving is rendered possible, without any large amount of loss, thereby meeting the requisites for a component of an ignition system in an internal combustion engine.

DESCRIPTION OF THE PREFERRED EMBODIMENT

Figure 1:
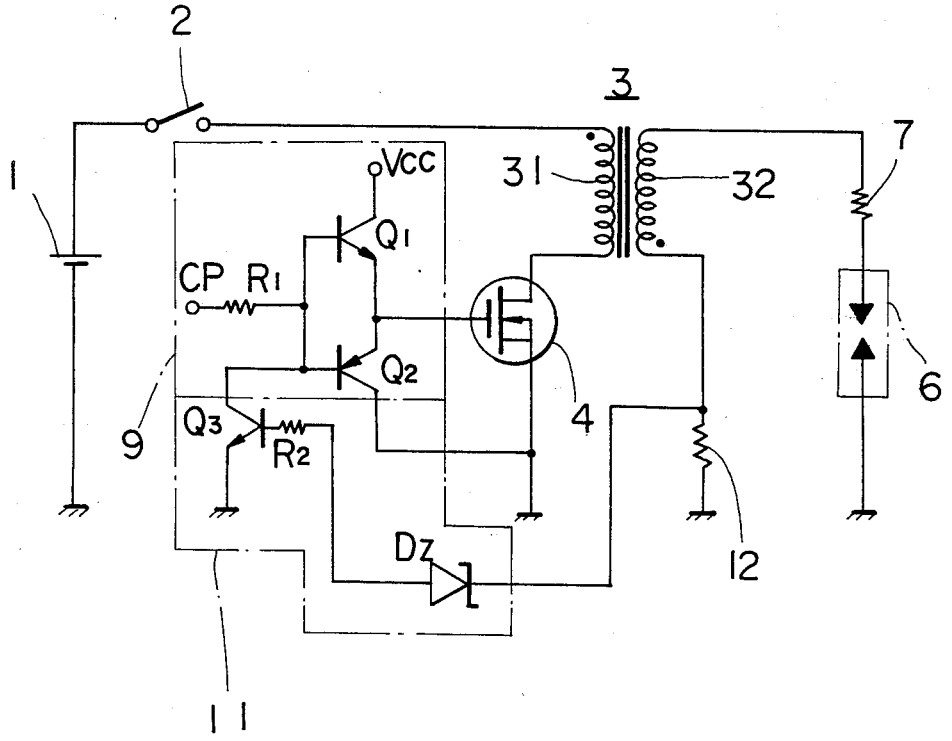
FIG. 1 is a schematic circuit diagram of a discharge load driving circuit of the present invention.
Figure 3:
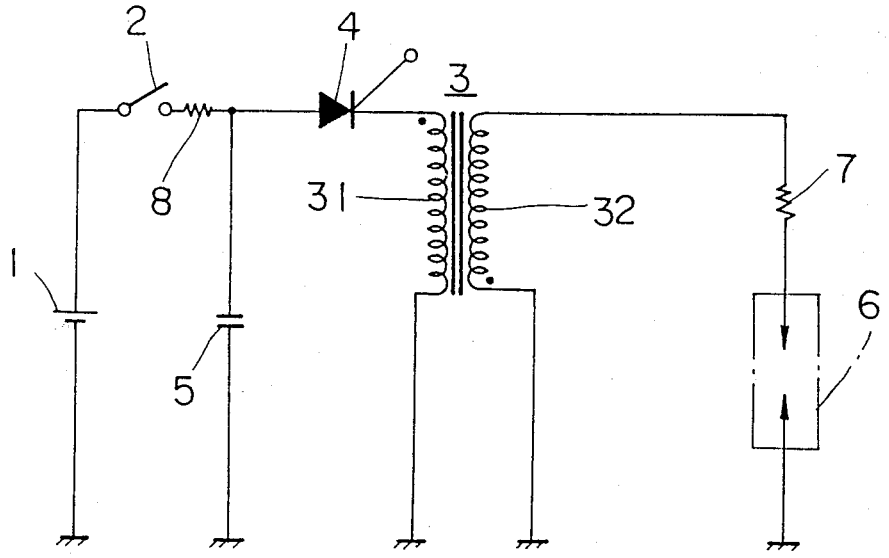
FIG. 3 is a schematic circuit diagram of a conventional discharge load driving circuit.
Figure 4:
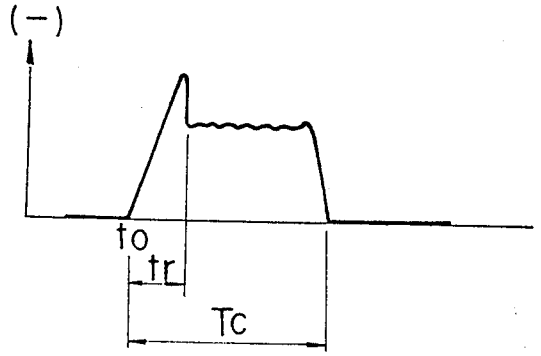
FIG. 4 is a waveform chart showing the coil voltage of a transformer in the circuit of FIG. 3.
Figure 5:
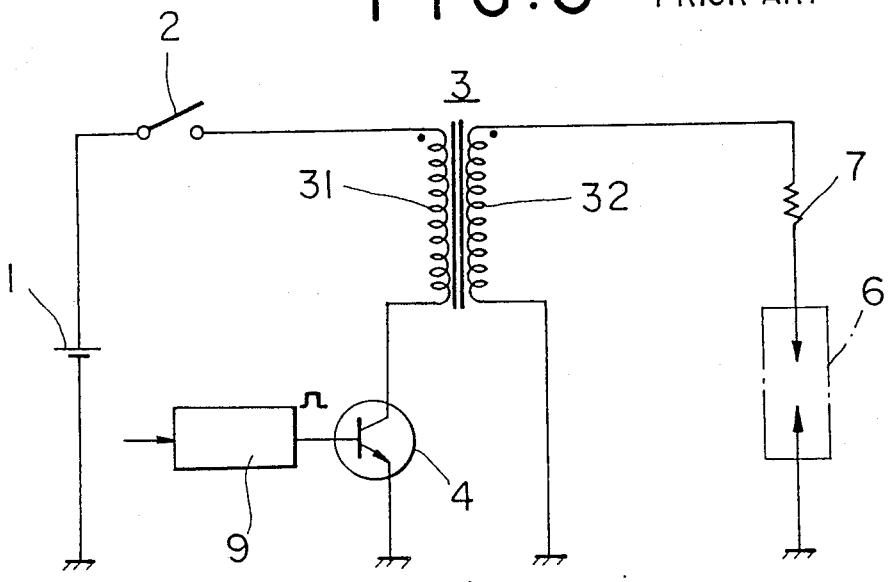
FIG.5 PRIOR ART
FIG. 5 is a schematic circuit diagram of another conventional discharge load driving circuit.
Figure 6:
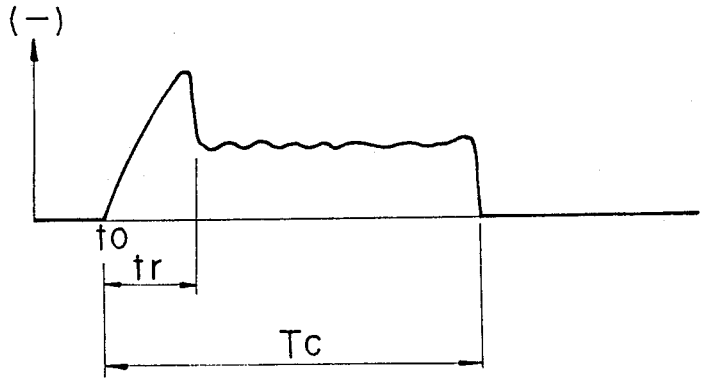
FIG. 6 is a waveform chart showing the coil voltage of a transformer in the circuit of FIG. 5.

FIG. 1 shows an electric circuit diagram of a discharge load driving circuit according to the present invention. In this diagram, the same reference numerals as those used in the aforementioned conventional circuits of FIGS. 3 and 5 denote corresponding component parts. In a transformer 3, the polarity of a low voltage coil 31 and a high voltage coil 32 wound around a magnetic core 30 is so predetermined that a high voltage output generated in the high voltage coil 32 is applied to a discharge load 6 in accordance with turn-on of a switching element 4. Denoted by 11 is a control circuit consisting of a transistor $Q_3$, a resistor $R_2$ and a Zenerdiode $D_z$ and including a pulse width control circuit and so forth, and connected between a resistor 12 serving as an electic current detector on the secondary side and a driver circuit 9. Although the switching element 4 in this embodiment consists of a MOS field-effect transistor, it may be replaced with a bipolar transistor. The driver circuit 9 comprises two transistors $Q_1$ and $Q_2$ connected between a DC power source $V_{cc}$ and the earth, and a resistor $R_1$ connected between a common connection base for those transistors and a control signal terminal CP.

The magnetic core 30 is composed of, e.g., ferrite or similar material having an initial permeability of 1500 or more at a frequency of 200 kHz and a saturation magnetic flux density of 300 mT or more in a field strength of 1600 A/m at a temperature of 120° C.

When the switching element 4 is turned on in the circuit configuration mentioned, a high voltage output transferred from the low voltage coil 31 of the transformer 3 to the high voltage coil 32 thereof is fed to the discharge load 6 to consequently generate a spark discharge in the load 6. In this case, the high voltage applied to the discharge load 6 is negative in reference to the ground.

The requisite is satisfied if the low voltage coil 31 and the high voltage coil 32 of the transformer 3 are coupled to each other at a certain transformation ratio, and the required inductance L of the transformer 3 may be lower than that in the flyback type, so that the self-resonance frequency f of the transformer 3 can be set at a higher value, and therefore it becomes possible to realize a short rise time Tr substantially equal to that in the known CDI system.

Figure 2:
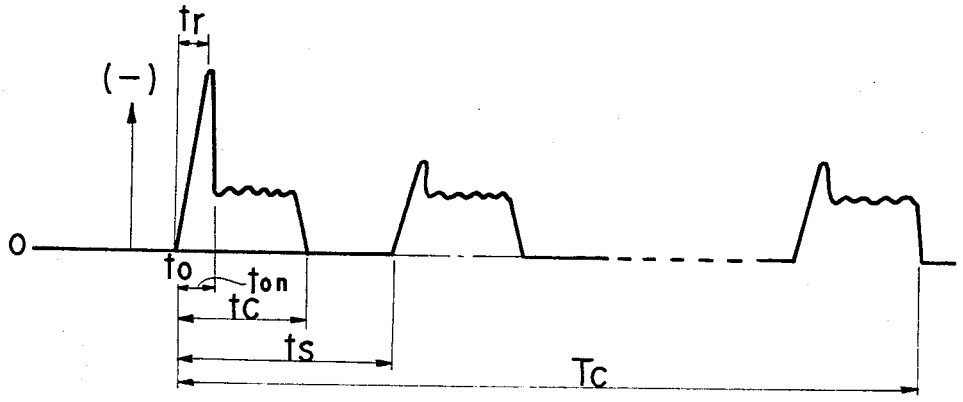
FIG. 2 is a waveform chart showing the coil voltage of a transformer in the circuit of FIG. 1.

Furthermore, due to the circuit configuration where the high voltage output generated in the high voltage coil 32 is fed to the discharge load 6 in accordance with turn-on of the switching element 4, the high voltage output obtained comes to have a duration corresponding to the width of the switching-element driving pulse, so that the on-off action of the switching element 4 can be repeated in a predetermined short period for supplying the discharge energy to the discharge load 6 until self-propagation of a flame subsequent to generation of a flame nucleus by the spark discharge of the discharge load 6, hence equivalently extending the duration of high voltage application. For example, as shown in FIG. 2 where Tc represents the duration required until self-propagation of a flame from generation of a flame nucleus by the spark discharge of the discharge load 6, the switching element 4 is repeatedly turned on and off with its on-time $t_{on}$ in the duration Tc. When the switching element 4 is driven with its on-time $t_{on}$, the length of each duration $t_c$ is shorter than the duration Tc, but due to the repetition of such action, the required duration Tc can be ensured equivalently. The optimal period $t_s$ for repeatedly turning on and off the switching element 4 is considered to be less than 500 μs.

A detector 12 detects the flow of discharge current in the discharge load 6 and produces a detection signal, which is then fed to a control circuit 11. And an output signal of the control circuit 11 serves to halt the operations of both the driver circuit 9 and the switching element 4.

Since the material of the core 30 employed in the embodiment is superior in magnetic characteristics to the known one, the numbers of turns of the low voltage coil and the high voltage coil can be relatively reduced to diminish the distributed capacity in the windings. And due to the high initial permeability in the high frequency range, a sufficiently great inductance can be attained despite such small numbers of turns, and further the use at high temperature is permitted. Consequently, high voltage pulses can be generated in the discharge load 6 by supplying fast pulses to the switching element 4, whereby it is rendered possible to provide a satisfaction discharge load driving circuit which functions as a component of an ignition system in an internal combustion engine. Considering the high-speed rotational drive of the internal combustion engine, it is desired that the on-time of the switching element be shorter than 50 μs per discharge.

What is claimed is:

1. A discharge load driving circuit, comprising:

a transformer having a low voltage coil and a high voltage coil wound around a magnetic core, said high voltage coil having a transformation ratio for setting a high self-resonance frequency value for said transformer to thereby output high voltage at a short rise time;

a switching element operably connected to said transformer for switching on and off a d-c input supplied thereto through the low voltage coil of said transformer;

a driver circuit for driving a switching element driving pulse;

a control circuit for controlling said driver circuit;

a discharge load connected to said high voltage coil for discharging load by a high voltage output generated in said high voltage coil when said switching element is turned on; and a detector for detecting a flow of discharge current in said discharge load;

said switching element repeates its on-off action in a predetermined period for supplying a required amount of discharge energy to said discharge load until self-propagation of a flame subsequent to generation of a flame nucleus by a spark discharge of said discharge load.

2. The discharge load driving circuit according to claim 1, wherein said magnetic core is comprised of a selected material having an initial permeability of at least 1500 at a frequency of 200 kHz, and a saturation magnetic flux density of at least 300 mT in a field intensity of substantially 1600 A/m at a temperature of substantially 120° C.

3. The discharge load driving circuit according to claim 1, wherein said switching element comprises an electric field effect transistor.

4. The discharge load driving circuit according to claim 1, wherein the period of on-off repetition is less than 500 μs for said switching element.

5. The discharge load driving circuit according to claim 1, wherein the ON-period per discharge is less than 50 μs for said switching element.

* * * * *